United States Patent [19]

Cognigni et al.

[11] 3,937,000

[45] Feb. 10, 1976

[54] CONTINUOUS BI-COMPOUND ACRYLIC BULKY YARN AND THE METHOD OF THE PRODUCTION OF SAME

[75] Inventors: Franco Cognigni, Cesano Maderno; Silvano Cesca, San Donato Milanese, both of Italy

[73] Assignee: Snam Progetti S.p.A., San Donato Milanese, Italy

[22] Filed: Sept. 15, 1972

[21] Appl. No.: 289,230

[30] Foreign Application Priority Data

Sept. 16, 1971 Italy ..... 28708/71
July 7, 1972 Italy ..... 26731/72

[52] U.S. Cl. ..... 57/157 TS; 57/140 BY; 57/157 S
[51] Int. Cl.[2] ..... D02G 1/02
[58] Field of Search ..... 57/140 BY, 157 S, 157 TS

[56] References Cited

UNITED STATES PATENTS

| | | | |
|---|---|---|---|
| 3,022,565 | 2/1962 | Fitzgerald | 57/157 TS |
| 3,404,525 | 10/1968 | Tompkins | 57/157 TS |
| 3,434,276 | 3/1969 | Fujita et al. | 57/140 BY |
| 3,472,017 | 10/1969 | Nakayama et al. | 57/140 BY |
| 3,535,866 | 10/1970 | Tsuruta et al. | 57/157 TS X |
| 3,601,972 | 8/1971 | Rogers et al. | 57/151 TS |
| 3,626,684 | 12/1971 | Hows et al. | 57/140 BY |

*Primary Examiner*—John W. Huckert
*Assistant Examiner*—Charles Gotenstein
*Attorney, Agent, or Firm*—Ralph M. Watson, Esq.

[57] ABSTRACT

A continuous bi-compound bulky yarn consisting of a pair of acrylic polymeric components differing from each other in some of their properties is prepared by spinning those components in solution to produce a spun yarn which is drawn and then, successively, passed through a first oven heated to a temperature in the range of 130°–250°C, subjected to a false twist by means of a rotating spindle, passed through a second oven heated to a temperature in the range of 120°–240°C, and wound on a holder.

5 Claims, 4 Drawing Figures

Figure 1:
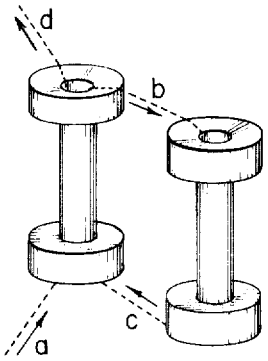

CONTINUOUS BI-COMPOUND ACRYLIC BULKY YARN AND THE METHOD OF THE PRODUCTION OF SAME

This invention refers to a bi-compound acrylic bulky yarn and the method of the production of same.

Continuous yarns of other types are already known in this field and in particular amongst these, are those of an acrylic nature.

The production of acrylic fibres was promoted by the fact that the basic monomers cost considerably less than those monomers used in the production of polyamides and polyesters. Moreover, the acrylic polymers are produced by means of very simple and cheap suspension or emulsion polymerization processes and may have variable properties within wide limits without incurring additional costs or processing complications.

The transformation of the acrylic polymers into fibres is achieved by spinning in solution. Two methods of spinning are known: wet and dry. The dry technique is particularly advantageous for the high spinning speeds for obtaining continuous yarns.

The most widely used solvents for dry spinning are: dimethylformamide, dimethylphormamide and dimethylsulphoxide.

To give bulk to such continuous yarns many methods, such as mechanical crimping by compression in a compression chamber, false twisting by means of spindles operating at a very high number of revs per minute, texturization on a knife blade (hot), fluffing with air or gas, and texturizing by means of stitching and unstitching, have been studied. Another method for obtaining bulky yarns consists of producing self-crimping yarns which are composed of two components which each behave in a different manner when the yarn is subjected to specific treatments (physical or chemical).

To obtain bi-compound filaments, pairs of acrylic polymers, each having a different chemical and/or physical make up, are used. These polymeric pairs are differentiated by their different content of neutral comonomers, their different content of comonomers or polymers having ionizable groups, and their different content of comonomers and polymers of a hydrophylic nature.

The most widely used neutral comonomers are: methyl acrylate, ethyl acrylate, methylmethacrylate, vinyl acetate, acrylamide, vinyl pyrrolidon, vinyl chloride, and vinyliden chloride, butyl acrylate.

The comonomers with ionizable groups which are copolymerizable with acrylonitrile are: allyl-methallyl, vinylbenzene-sulphonic acids, acrylic, methacrylic, itaconic, citraconic and cinnamic acids and their salts.

The comonomers and polymers having a hydrophylic nature are: vinylpyrrolidon, vinylacetamide, acrylamide and their polymers.

Now we go on to examine the known draw-backs when the constituents of the filament are acrylic compounds. In the case of yarns with filaments composed of a single acrylic polymer or copolymer, it can be noted that said yarns after texturizing, show a good hand, but they are not resistent during heat treating, particularly that involved during the dyeing processes.

It follows that the yarns must be dyed before texturizing and consequently the finished piece cannot be washed in very hot water as it would, totally or almost entirely, lose the bulk given by the texturization and the product would no longer hold any interest.

Dyeing prior to texturization creates considerable difficulties due to the impossibility of being able to follow fashion trends and due to warehouse stocks and production remnants.

The draw-backs involved as far as bi-compound yarns are concerned, are essentially due to the fact that the crimping produced during their development is not generally very uniform. This inequality of crimping is caused by the fact that the single filaments making up the yarns at the moment of their introduction into the development oven, either due to oiling of spinning or electrostatic phenomena, are never completely separated one from the other, and therefore during crimping some areas, in which all or a good part of the filaments crimp together in stages, are produced. The single filaments making up the yarns in such areas, that is, do not crimp individually to create a bulky yarn but instead become entangled in the same direction amongst themselves and as a a result the yarn has only a sparse bulk.

All the above-mentioned facts lead to the presence of areas of a high degree of bulk and others of considerably reduced bulk, in the yarns. As a result, the yarns are particularly sensitive during dyeing wherein normally coloured patches alternating with patches of a lighter or darker colour are obtained.

It has been found, and this represents the subject matter of the invention, that a texturized bi-compound acrylic fibre does not have the same disadvantages as the texturized acrylic fibres made up of only one polymer or copolymer or those bi-compound acrylic yarns developed according to conventional methods.

Each filament of the bulky continuous bi-compound yarn of the invention is made up of a pair of acrylic polymeric components each of which have different chemical and/or physical properties. The polymeric components have a base of polyacrylonitrile, which may also represent the only constituent of such polymeric components. The two polymeric components are differentiated by their different plasticizing comonomer content, namely methyl acrylate, methyl methacrylate, vinyl acetate, ethyl acrylate, butyl acrylate, vinyl chloride, vinyliden chloride; the polymeric components on the other hand can be differentiated by their different content of ionizable groups, namely allylmethallyl-, vinylbenzene-sulphonic acids, acrylic, methacrylic, itaconic, citraconic and cinnamic acids and their salts (in which case the copolymers making up each of the components of the filament are obtained as a result of the copolymerization of acrylonitrile with the above-mentioned compounds: allyl-methallyl, vinylbenzene-sulphonic acids, etc.); (different ionizable groups are obtainable also by varying the catalytic system of the polymerization); finally, the polymeric components can be differentiated by their different hydrophylic degree, (in which case the copolymers making up each of the components of the filament are obtained either through the copolymerization of acrylonitrile with compounds such as vinylpyrrolidon, acrylamide and vinylacetamide, or by mixing some of the above-mentioned substances in the polymeric form with acrylic polymers.

It should be noted moreover, that the polymeric components can be formed by copolymerization of acrylonitrile not only with the comonomers of only one of the afore-mentioned groups, but also with the comonomers of two or all the groups, the quantities of the comonomers, in addition to the first, being the same or different in the two components, with at least one of the two comonomers being in a different quantity, in the two components of the filament. The number of waves per centimeter of the yarn ranges from 4 to 15 and is preferably between 7 and 12; the rate of crimping ranges from 5% to 20% and is preferably between 8% and 15%; the rate is determined in accordance with the following formula:

$$\text{Rate (\%)} \frac{\text{Llength under Length of 100 mg/den.-Length under load of 1 mg/den.}}{\text{Length under load of 100 mg/denier}} \cdot 100$$

Elongation ranges from 10% to 30%.

Crimping results are mechanically stable up to a load of 1.5 mg/denier.

The permanency of the crimping, after treatment in boiling water for 5 minutes with 0.1 mg/denier tension, is total; in fact, the crimping proves to be increased in an amount which varies according to texturizing method used.

The yarn shows no dyeing defects and its appearance improves after the dyeing process has been carried out; however, it appears full and soft.

A further point of the invention is the manufacturing process of the continuous acrylic bulky bi-compound yarn.

The spun yarn after drawing, is passed through a first oven heated to a temperature of between 130°C and 230°C, preferably 160°C, and is then subjected to false twisting by means of a spindle rotating at a rate of between 100,000 r.p.m. to 1,000,000 r.p.m. with the feeding speed of said spindle ranging from 500 to 1000 m/minute, which produces a number of (false) twists of from 1000 to 2000 per meter, preferably 1600 per meter; after the false twisting stage, the yarn passes into a second oven heated to a temperature between 120°C and 200°C, and preferably around 150°C. The second oven may, however, be eliminated and in this case a yarn with a twisting moment is obtained. In this case, the yarn must be used with particular care in order that the finished article does not show tensions which tend to deform its shape. It is therefore necessary to use a binate made up of fibres with S and Z twists and work with multi feed machines, alternating fibres with S twists with those having Z twists.

Below, by way of illustration, though not of limitation, are listed some examples, with a view to giving a better idea of what the invention entails.

EXAMPLE NO. 1

Below are recorded the conditions of the tests and the results obtained thereby, for a texturized continuous yarn constituted by filaments formed of a 91.5% acrylonitrile, 8% methyl acrylate, 0,5% sodium methallylsulphonate, copolymer (Column A) and for a texturized bi-compound continuous yarn (Column B) constituted by filaments formed of the following copolymer pair:

a. 91.5% acrylonitrile — 8% methyl acrylate — 0.5% sodium methallylsulphonate b. 94.5% acrylonitrile — 5% methyl acrylate — 0.5% sodium methallylsulphonate with 50/50 conjugation.

The two yarns were obtained by dry spinning of 30% dimethylformamide solution under the following spinning conditions:

Spinneret with 40 holes of 250 $\mu$ diameter

Head temperature: 140°C

Column temperature: 200°C

Temperature of the solvent evaporating means (nitrogen): 210°C

Collection speed at bottom of column: 200 m/minute

The filaments, after washing to eliminate any residues of solvent, were drawn with a drawing ratio of 5 in superheated steam at 150°C at a final speed of 500 m/minute.

| Texturizing Conditions | A | B |
|---|---|---|
| Entry speed into 1st oven (m/minute) | 150 | 150 |
| Temperature of 1st oven (°C) | 160 | 160 |
| Revs of false twist spindle (Revs = Revolutions) | 240,000 | 240,000 |
| % of overfeeding = $\frac{\text{oven feeding speed - oven leaving speed}}{\text{oven feeding speed}} \cdot 100$ | +7 | +7 |
| Temperature of 2nd oven (°C) | 150 | 150 |
| Collection speed (m/minute) | 125 | 125 |
| Properties of the yarn | | |
| Count (denier) | 80/40 | 80/40 |
| Tenacity (g/denier) | 2.6 | 2.6 |
| % Elongation | 14 | 14 |
| No. of waves per centimeter | 6 | 9 |
| Rate of crimping (%) | 12 | 12 |
| Mechanical stability of crimping (g/denier) | 0.9 | 0.9 |
| No. of waves per centimeter after boiling | 1-2 | 11 |
| % Rate after boiling | 6 | 16 |
| Look of the knitted fabric before dyeing (boiling) | empty | good |
| Look of the knitted fabric after dyeing (boiling) | empty | good |

EXAMPLE NO. 2

The same yarns as in the first example were texturized under the following conditions (Column A for the yarn with filaments of one copolymer, Column B for the yarn with filaments of 2 copolymers):

| Texturizing Conditions | A | B |
|---|---|---|
| Entry speed into 1st oven (m/minutes) | 150 | 150 |
| Temperature of 1st oven (°C) | 160 | 160 |
| Revs. of false twist spindle | 375,000 | 270,000 |
| % of overfeeding | +7 | +7 |
| Temperature of 2nd oven (°C) | 150 | 150 |
| Collection speed (m/minute) | 125 | 125 |
| obtaining the following results : | | |
| Count (denier) | 80/40 | 80/40 |
| Tenacity (g/denier) | 1,5 | 2,4 |
| Elongation (%) | 13 | 13 |
| No. of waves per centimeter | 11 | 11 |
| Rate (%) | 12 | 12 |
| Mechanical stability of crimping (g/denier) | 0.9 | 0.9 |
| No. of waves per centimeter after boiling | 3-4 | 13 |
| % Rate after boiling | 6 | 17 |
| Look of the knitted fabric before dyeing (boiling) | good | good |
| Look of the knitted fabric after dyeing (boiling) | empty | good |

EXAMPLE NO. 3

The same yarns as used in EXAMPLE 1, were subjected to the following texturizing conditions, (in Column A, the yarn with filaments of one copolymer; in Column B the yarn with filaments of two copolymers).

| | A | B |
|---|---|---|
| Entry speed into 1st oven (m/minute) | 150 | 150 |
| Temperature of 1st oven (°C) | 160 | 160 |
| Revs false twist spindle | 225,000 | 225,000 |
| % of overfeeding | +7 | +7 |
| Temperature of 2nd oven (°C) | 150 | 150 |
| Collection speed (m/minute) | 125 | 125 |
| obtaining the following properties : | | |
| Count (denier) | 80/40 | 80/40 |
| Tenacity (g/denier) | 2.8 | 2.8 |
| Elongation (%) | 15 | 15 |
| No. of waves per centimeter | 4 | 7 |
| Rate (%) | 11 | 11 |
| Mechanical stability of crimping (g/denier) | 0.9 | 0.9 |
| No. of waves per centimeter after boiling | 0 | 10 |
| % Rate after boiling | 0 | 15 |
| Look of the knitted fabric before dyeing (boiling) | empty | slightly empty |
| Look of the knitted fabric after dyeing (boiling) | empty | good |

On the basis of the results of the three foregoing examples, it can be noted how the conjugate filament yarn, (Column B) requires fewer twists whilst giving better results than the single copolymer yarn (Column A). Therefore texturizing productivity may be increased, as can be seen hereinbelow in EXAMPLE 4.

EXAMPLE NO. 4

In this example the conjugate filament yarn of the aforegoing example was texturized in the following conditions:

| | |
|---|---|
| Entry speed into 1st oven (m/minute) | 250 |
| Temperature of 1st oven (°C) | 180 |
| Revs false twist spindle | 375,000 |
| % of overfeeding | +7 |
| Temperature of 2nd oven | 170 |
| Collection speed (m/minute) | 210 |
| obtaining the following properties : | |
| Count (denier) | 80/40 |
| Tenacity (g/denier) | 2.6 |
| Elongation (%) | 15 |
| No. of waves per centimeter | 6 |
| Rate (%) | 11 |
| Mechanical stability of crimping (g/denier) | 0.9 |
| No. of waves per centimeter after boiling | 9 |
| % Rate after boiling | 16 |
| Look of the knitted fabric before dyeing (boiling) | slightly empty |
| Look of the knitted fabric after dyeing (boiling) | good |

As can be seen from the above-mentioned examples, the conjugate filament yarn texturized with an equal number of twists per meter, shows better crimping and hand of the knitted fabric, when compared to the single copolymer yarn both before and after boiling (or dyeing), (EXAMPLE 1).

To obtain a single copolymer yarn of the same bulk (look) it is necessary to considerably increase the number of twists which leads, however, to a notable reduction of tenacity, without improving to any great extent the thermic stability during boiling and dyeing.

On the other hand, the texturized conjugate filament yarn develops its bulk during boiling (or dyeing) and can therefore receive fewer twists in the texturising phase, obtaining an equally satisfactory product as far as the look (touch) is concerned, (EXAMPLE 3).

All this leads to increased productivity, together with an improved quality of the yarn after boiling, (EXAMPLE 4).

EXAMPLE NO. 5

The untexturized conjugate filament yarn was developed, after having been drawn, in a hot air oven at a speed of 150 m/minute, without contact, at a temperature of 200°C.

During the treatment, the yarn undergoes shrinkage at a rate of 30%.

The properties of the yarn obtained are the following:

| | |
|---|---|
| Count (denier) | 86/40 |
| Tenacity (g/denier) | 2.8 |
| Elongation (%) | 30 |
| No. of waves per centimeter | 10 |
| Rate (%) | 10 |
| Mechanical stability of crimping | 0.9 |
| No. of waves per centimeter after boiling | 10 |
| % Rate after boiling | 14 |
| Look of the knitted fabric before dyeing (boiling) | good |
| Look of the knitted fabric after dyeing (boiling) | good |
| Dyeing defects | very apparent |

As compared to the texturized conjugate filament yarn the dyeing defects due to the lack of crimping uniformity, are considerable.

The method described above is based on a texturization with a conventional bar spindle of the bi-compound yarn after a heating at a temperature of from 130°C to 230°C, preferably of about 160°C and a further heating at a temperature of from 120°C to 200°C, preferably of about 150°C.

We have found that it is possible to carry out said texturization also with friction type spindles, obtaining contemporaneously remarkable advantages. The method remains on the whole unchanged, except that the texturization is effected with friction systems.

The bulking by means of a friction spindle presents the remarkable advantage that said operation can be carried out at a speed much higher than that possible with bar spindles and therefore with a friction spindle the bulking effect can be obtained with a much lower number of revolutions of the spindle.

The number of revolutions of the friction spindle for bulking continuous acrylic bi-compound yarns is in the range of from 5000 to 50000 per minute, preferably from 20000 to 25000.

The feed speed to the spindle is in the range of from 50 to 1000 m/minute.

The temperature of the 1st fixing oven is in the range of from 130° to 250°C, preferably from 210°C to 220°C, while the temperature of the 2nd fixing oven is in the range of from 120°C to 240°C, preferably from 130°C to 150°C.

In the accompanying drawings, FIGS. 1 to 4 show friction texturization spindles which can be used with advantage in the practice of the invention.

In FIG. 1 there is shown a friction spindle constituted by two hollow cylinders provided with disks at their ends; the yarn (dashed line) follows the path *a*, *b*, *c*, *d*, so that by rotation of the two cylinders a false twist is produced.

Figure 2:
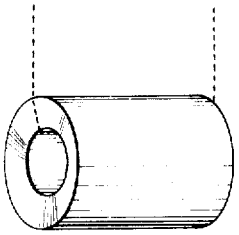

In FIG. 2 a friction spindle is shown constituted by a cylinder inside which the yarn to be texturized passes; the cylinder by its rotation produces false twists.

Figure 3:
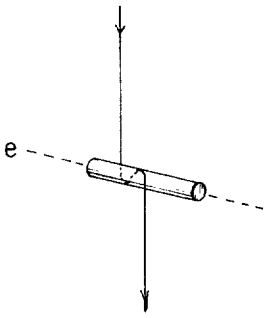

In FIG. 3 a friction spindle is shown constituted by an idle cylinder rotating around axis *e* suitably sloped with respect to a horizontal plane; the yarn is wound for one or more helices on the surface of said cylinder and produces the rotatory motion of the same cylinder.

Figure 4:
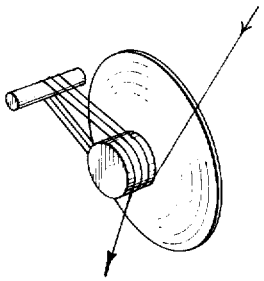

In FIG. 4 a friction spindle is shown constituted by a disk; the yarn touches the disk surface, preferably near its edge, and by rotation of the disk is subjected to false twist.

The shown friction texturization devices obviously are not the only ones which can be used for producing false twists since use can be made advantageously of all known friction texturization devices.

For illustrative but unrestrictive purposes the data obtained with the method according to the present invention will now be reported.

EXAMPLE 6

Two acrylic copolymers (A and B) obtained by polymerization in aqueous solution of the monomers ACN (acrylonitrile), AM (methyl acrylate), MASNa (sodium methallylsulphonate) in the ratios.

A: 91.5% ACN; 8% AM; 0.5% MASNa

B: 94.5% ACN; 5% AM; 0.5% MASNa were dissolved in N-N dimethyl formamide (DMF) at a concentration of 30% for copolymer A and 27% for copolymer B.

The polymeric solutions were dry spun in side by side conjugation at the under listed spinning conditions:

Spinning head temperature: 140°C

Evaporation column temperature: 200°C

Temperature of nitrogen for removing solvent: 210°C

Collection speed at the column bottom: 300 m/minute

The yarn was washed to eliminate the residual solvent and then drawn in steam at 150°C with a drawing ratio equal to 5 and at a drawing speed of 700 m/minute.

The drawn yarn with a count of 80/30 filaments was texturized by means of a texturizing machine provided with a friction spindle like the one shown in FIG. 1 under the following conditions.

| | |
|---|---|
| Feed speed | 350 m/minute |
| Temperature of the fixing oven | 215°C |
| No of revolutions of the spindle | 23,000 per minute |
| % of overfeeding to the fixing oven | +8 |
| Collection speed | 312 m/minute |

The yarn so obtained was analyzed and knitted obtaining the following characteristics:

| | |
|---|---|
| Count | 88/30 |
| Tenacity | 2.5 grams/denier |
| Elongation: | 11.9% |
| Shrinkage in boiling water | 11.0% |
| Bulkiness of the yarn as such: | |
| Waves/cm | 6.4 |
| Rate % : | 10.5 |
| Bulkiness of the boiled yarn : | |
| Waves/cm : | 7.5 |
| Rate % . | 23.0 |
| Estimation of the knitted fabric | |

-continued

| | |
|---|---|
| knitted fabric as such : | slightly empty look |
| Dyed knitted fabric: | full look |
| Dyeing regularity: | good. |

EXAMPLE 7

A yarn obtained as described in example 1 but having a count equal to 50/30 filaments was texturized with a friction spindle of the type shown in FIG. 1 under the following conditions:

| | |
|---|---|
| Feed speed: | 400 m/minute |
| 1st fixing oven temperature: | 220°C |
| Revolutions of the spindle: | 25,000 per minute |
| % overfeeding to the lst oven | + 7% |
| 2nd fixing oven temperature | 140°C |
| Collection speed | 335 m/minute |

The yarn so obtained was analyzed and knitted obtaining the following characteristics:

| | |
|---|---|
| Count | 58/30 |
| Tenacity | 2.7 g/denier |
| Elongation | 13% |
| Shrinkage in boiling water | 9.3% |
| Bulkiness of the yarn as such | |
| Waves/cm | 12 |
| Rate % | 11.5 |
| Bulkiness of the boiled yarn | |
| Waves/cm | 12 |
| Rate % | 25 |
| Estimation of the knitted fabric | |
| knitted fabric as such and dyed: | good look |
| Dyeing regularity: | good |

EXAMPLE 8

Two acrylic polymers A and B obtained by polymerization of the monomers.

A: 91.5% ACN; 8% AM; 0.5% MASNa

B: 100% ACN were dissolved in DMF at the concentrations respectively of 30% and 22% and dry spun with a conjugation 50/50 under the spinning conditions of example 2.

The yarn was drawn and texturized as in example 2.

The obtained results were the following ones:

count (denier) 58/30

Tenacity: 2.8 g/denier elongation %: 12

Shrinkage in water at 100°C (%): 9%

Bulkiness of the yarn as such:

waves/cm: 12 rate %: 11

Bulkiness of the boiled yarn waves/cm: 13 rate %: 26

Estimation of the knitted fabric:

knitted fabric as such: good look dyed knitted fabric: good look dyeing regularity: good.

EXAMPLE 9

Two acrylic copolymers A and B obtained by polymerization of the monomers:

A: 91.5% ACN; 8% AM; 0.5% MASNa

B: 94.5% ACN; 4% AM; 1.5% MASNa were dissolved in DMF at the concentration of 30% and 27% respectively, spun in conjugation 50/50, drawn and texturized as in example 2.

The obtained results were the following ones:

count (denier): 59/30
tenacity (g/denier): 2.6
elongation %: 13%
Shrinkage in water at 100°C (%): 9.5
Bulkiness of the yarn as such
waves/cm 10
rate % 11
Bulkiness of the boiled yarn
waves/cm 9
rate % 24
knitted fabric as such and dyed: good look
Dyeing regularity: good.

The yarn of the preceding examples was drawn by a two stage process as follows: the spun yarn fed by means of a couple of rolls at 140 m/minute was drawn in steam at 150°C by a couple or rolls at 583 m/minute heated at 170°C; subsequently the yarn was subjected to a second drawing of 20% by means of a second couple of rolls at a velocity of 700 m/minute. The total drawing of 1:5 was so divided:

In the 1st drawing stage in the presence of steam, the drawing ratio was 1:4.16.

In the 2nd drawing stage with rolls at 170°C, the drawing ratio was 1:1.20.

We claim:

1. Method for the production of a bulky acrylic bicompound, continuous yarn consisting of a pair of acrylic polymeric components differing from each other in some of their properties, characterized by from 4 to 15 waves per centimeter and a crimping rate ranging from 5% to 20%, wherein the yarn is drawn, the drawn yarn is passed through a first oven heated to a temperature in the range from 130°C to 230°C, is then subjected to a false twist by means of a rotating spindle, is then passed into a second oven, heated to a temperature of from 120°C to 200°C, and is then wound on a holder.

2. Method in accordance with claim 1, where the spindle rotates at a rate of between 100,000 and 1,000,000 revolutions per minute, the spindle feeding speed varies between 50 and 1,000 meters per minute, so that from 1,000 to 2,000 false twists are produced per meter.

3. Method for the production of a bulky acrylic bicompound, continuous yarn according to claim 1, wherein the drawn yarn is passed through said first oven at a temperature in the range of from 210° to 220°C, is then subjected to a false twist by means of a friction spindle, and is then passed through said second oven at a temperature in the range of from 130° to 150°C.

4. Method as claimed in claim 1 wherein the spindle makes from 5000 to 50000 revolutions per minute, and the feeding speed of the yarn to the spindle is in the range of from 50 to 1000 meters per minute.

5. Method for the production of a bulky acrylic bicompound, continuous yarn in accordance with claim 1, wherein each of said acrylic polymeric components is composed of a polyacrylonitrile base and the comonomers, methyl acrylate and sodium methallylsulphonate, the relative proportions thereof being different in the respective polymeric components.

* * * * *

UNITED STATES PATENT AND TRADEMARK OFFICE

CERTIFICATE OF CORRECTION

PATENT NO. : 3,937,000

DATED : February 10, 1976

INVENTOR(S) : Franco Cognigni and Silvano Cesca

It is certified that error appears in the above-identified patent and that said Letters Patent are hereby corrected as shown below:

First page, at the end of item "[56]" insert:

| | | | |
|---|---|---|---|
| -- 3,446,005 | 5/1969 | Kosaka, et al. | 57/140 BY |
| 3,458,390 | 7/1969 | Arido, et al. | 57/140 BY |
| 3,557,544 | 1/1971 | Simons | 57/140 BY |
| 969,110 | 9/1964 | Great Britain -- | |

Col. 1, line 25, before "dimethylformamide" insert -- dimethylacetamide --, and delete "dimethylphormamide".

Col. 3, line 11, correct spelling of "Length" (first occurrence), delete "length" (second occurrence) and substitute -- load --.

Col. 9, line 16, before "rolls" change "or" to -- of --.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*